US006355918B1

(12) United States Patent
Eckmyre

(10) Patent No.: US 6,355,918 B1
(45) Date of Patent: Mar. 12, 2002

(54) FOOD SUPPORT FOR USE IN A MICROWAVE OVEN

(76) Inventor: Carl E. Eckmyre, 46027 E. Sunrise Dr., Lexington Park, MD (US) 20653

( * ) Notice: Subject to any disclaimer, the term of this patent is extended or adjusted under 35 U.S.C. 154(b) by 0 days.

(21) Appl. No.: 09/512,212

(22) Filed: Feb. 24, 2000

(51) Int. Cl.[7] ..... H05B 6/80
(52) U.S. Cl. ..... 219/732; 108/156; 99/450
(58) Field of Search ..... 219/732; 108/156, 108/42, 64, 19; 99/450; 248/188

(56) References Cited

U.S. PATENT DOCUMENTS

| | | | | | |
|---|---|---|---|---|---|
| 3,865,050 | A | * | 2/1975 | Cecchetti | 108/19 |
| 4,011,821 | A | * | 3/1977 | Neal | 108/156 |
| 4,062,299 | A | * | 12/1977 | Smith | 108/42 |
| 4,249,464 | A | * | 2/1981 | Hansen | 99/450 |
| 4,455,467 | A | | 6/1984 | Dills | |
| 4,847,461 | A | | 7/1989 | Gilmore | |
| 5,174,197 | A | | 12/1992 | Upton | |
| 5,341,750 | A | * | 8/1994 | Fuchs | 108/64 |
| 5,726,428 | A | | 3/1998 | Christensen | |
| 5,957,418 | A | * | 9/1999 | Nelson | 248/188 |
| D421,353 | S | * | 3/2000 | Weiss | D6/484 |

FOREIGN PATENT DOCUMENTS

| | | | |
|---|---|---|---|
| DE | 3300958 A | * | 3/1987 |
| FR | 2698954 | | 10/1994 |
| JP | 189232 | | 10/1984 |

OTHER PUBLICATIONS

Nupac, Microwave Accessories Catalog Entry, Aug. 12, 1977.

* cited by examiner

*Primary Examiner*—Teresa Walberg
*Assistant Examiner*—Quang Van
(74) *Attorney, Agent, or Firm*—Stephen R. Greiner

(57) ABSTRACT

A food support for boosting the food-cooking capacity of a microwave oven. The support includes a plate having a number of legs extending downwardly therefrom. Each of the legs has a base adapted for selective insertion into a cup integrally fastened to the bottom of the plate. An arcuate stem projects downwardly from each base and bows outwardly for easy access to food items positioned beneath the plate.

1 Claim, 1 Drawing Sheet

FOOD SUPPORT FOR USE IN A MICROWAVE OVEN

FIELD OF THE INVENTION

The present invention relates generally to electrical heating apparatus and, in particular, cookware used therewith.

BACKGROUND OF THE INVENTION

Microwave ovens are typically provided with a small, cooking chamber so as to reduce oven size and lower cooking times by concentrating microwaves on foods placed therein. While millions have embraced the benefits of small microwave ovens, their principal drawback of being unable to cook large portions of food at one time has no doubt exasperated an equal number.

To increase the quantities of food that a microwave oven can cook in a given period of time, some people have proposed multi-tiered racks for stacking foods within the ovens' cooking chambers. Unfortunately, these racks have been complex in their construction and cumbersome to use. They have not seen great commercial success.

SUMMARY OF THE INVENTION

In light of the problems associated with the known racks for increasing the cooking capacity of microwave ovens, it is a principal object of the present invention to provide a food support for use in a microwave oven that is: uncomplicated in design, light in weight, inexpensive to manufacture and fully effective in use.

It is another object of the invention to provide a food support of the type described having a knockdown construction. Such a support can, thus, be easily disassembled by a user for washing or storing.

Briefly, the food support in accordance with this invention achieves the intended objects by featuring a plate having a plurality of cups integrally fastened to the bottom thereof. Each of the cups has a socket and a peripheral recess around the socket. A pin extends downwardly from the plate into each socket. The base of each of a plurality of legs is selectively inserted into each of the sockets. Each base has a bore in its top for snugly receiving one of the pins and a peripheral ridge for mated engagement with a peripheral recess. Each leg also has an arcuate stem that projects downwardly from the base so as to support the plate above the floor of a microwave oven and that bows outwardly for easy access to food items positioned beneath the plate The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
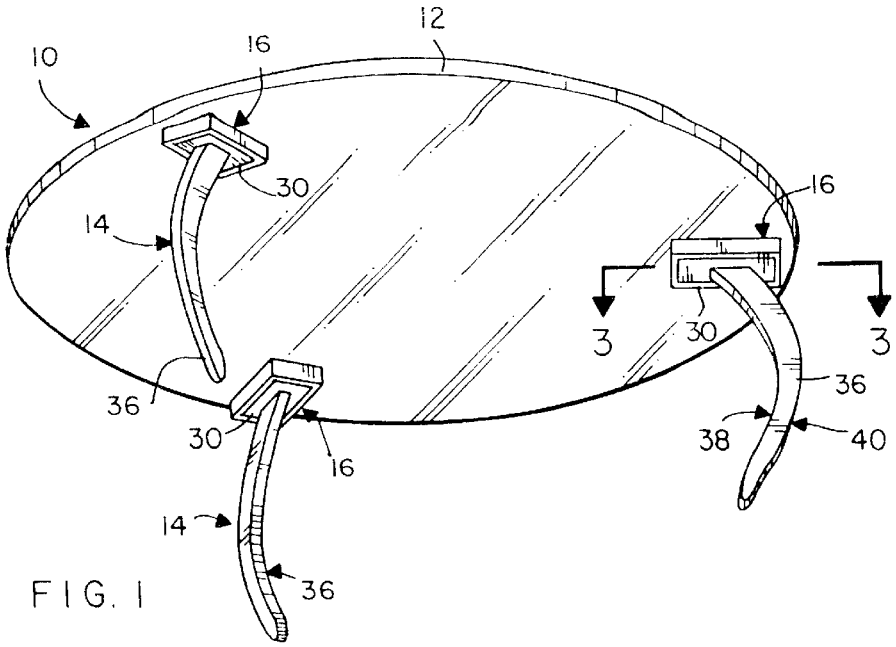
FIG. 1 is a perspective view of a support for use in a microwave oven in accordance with the present invention.

Referring now to the FIGS., a food support in accordance with the present invention is shown at 10. Support 10 includes a plate 12 from which a plurality of legs 14 extend downwardly so as to elevate plate 12 above a platform such as a microwave oven carousel or floor (not shown). Legs 14 are detachable from plate 12 thereby facilitating the washing and storing of support 10 when it is not in use.

Plate 12 is a disk about 12.75 inches (32 cm) in diameter and 0.25 inches (0.64 cm) thick. Integrally fastened to the bottom of plate 12 is a plurality of downwardly opening cups 16. Each cup 16 has a pair of opposed side walls 18 connected together by a pair of opposed end walls 20 so as to define therebetween a socket 22 with a rectangular shape. Preferably, side walls 18 are about 1.75 inches (4.45 cm) long and 0.25 inches (0.64 cm) tall whereas end walls 20 are about 1.25 inch (3.18 cm) long and have a similar height. Walls 18 and 20 are all about 0.125 inches (0.32 cm) thick.

Figure 2:
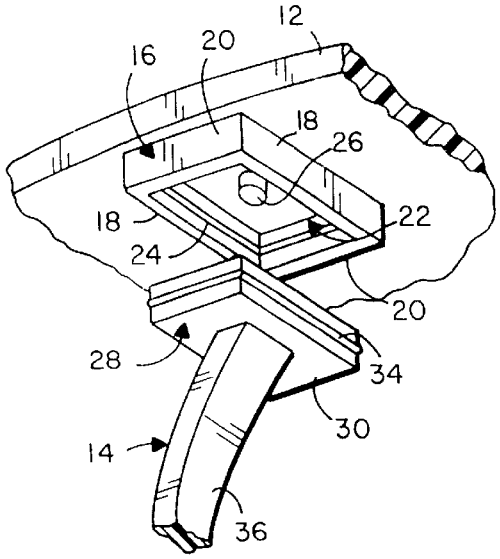
FIG. 2 is a perspective view of the upper portion of one leg of the support of FIG. 1 being inserted into a socket of the plate of said support.
Figure 3:
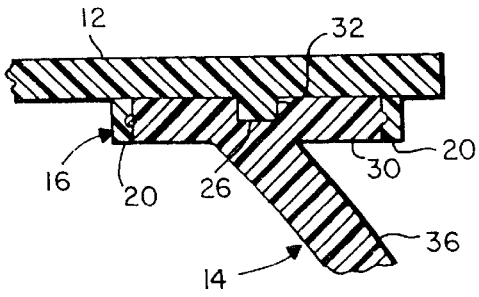
FIG. 3 is a cross-sectional view taken along line 3—3 of FIG. 1.

Cups 16 are each provided with a peripheral recess 24 and a pin 26 that permit legs 14 to be mechanically joined to plate 12. As shown in FIG. 2, each peripheral recess 24 bisects the inner surfaces of walls 18 and 20 into upper and lower halves. Each recess 24 measures approximately 0.063 inch (0.16 cm) in width and 0.031 inches (0.08 cm) in depth. Pin 26, on the other hand, projects downwardly from the bottom of plate 12 into the center of cup 16. Pin 26 is about 0.125 inches (0.32 cm) tall and 0.25 inches (0.64 cm) in diameter.

Legs 14 each include a base 28 adapted for releasable insertion into any one of cups 16. Base 28 comprises a rectangular block 30 measuring about 1.5 inches (3.81 cm) in length, 1 inch (2.5 cm) in width and 0.25 inches (0.64 cm) in height. A bore 32, having a diameter of about 0.25 inches (0.64 cm) is provided in the top of block 30 for snugly receiving pin 26. Also, a peripheral ridge 34 extends outwardly from the sides of block 30 and bisects such into upper and lower halves. Peripheral ridge 34 is dimensioned for a "snap" fit within any recess 24 being 0.063 inches (0.16 cm) in width and 0.031 inches (0.08 cm) in height.

Each of legs 14 has an arcuate stem 36 which projects downwardly from block 30 for engagement with a microwave oven carousel or the like. Arcuate stem 36 is a C-shaped plate having a concave, inner surface 38 and a convex, outer surface 40. Arcuate stem 36 is about 0.25 inches (2.5 cm) thick and about 3.75 inches (9.53 cm) tall. At its midpoint, arcuate stem 36 bows outwardly about 1 inch (2.5 cm) from an imaginary line connecting its uppermost and lowermost points that are substantially vertically aligned.

All parts of support 10 are molded from plastic although other microwave-transparent materials may be employed. Plate 12 and cups 16 are preferably integrally formed. Additionally, base 28 and stem 36 of each leg 14 are integrally formed. Thus, support 10 is constructed from a few easily made elements.

Use of support 10 is straightforward. First, legs 14 are attached to plate 12 by inserting their bases 28 into sockets 22. Support 10 is, next, positioned within the cooking chamber of a microwave oven. Then, food is positioned both atop plate 12 and between legs 14 with the cooking capacity of the oven being effectively doubled by such positioning. After cooking is completed, the food is removed from the oven with the bowed configuration of the stems 36 creating a relatively wide space between the midpoints of adjacent legs 14 through which larger plates can be moved. The entire process requires mere seconds to complete. After use, support 10 may be disassembled for cleaning in a dishwasher or for convenient storage in a drawer.

One should appreciate that support 10 is highly stable, being short and squat in statue. Because the upper and lower points of stems 36 are substantially vertically aligned, the weight of food on plate 12 does not tend to cause leg bases 28 to disengage from cups 16. Should the tendency ever develop due to unequal loading of plate 12, it is thwarted by the dual, failsafe features, i.e., the interlocking pin 26 and bore 32 as well as interlocking ridges 34 and recesses 24 provided to support 10. In other words, support 10 will not easily fall apart during us.

While the invention has been described with a high degree of particularity, it will be appreciated by those skilled in the art that modifications may be made thereto. For example, the number and location of the cups 16 as well as legs 14 may be increased if desired but this may limit the size of items which may be easily slid between the legs during use. Therefore, it is to be understood that the present invention is not limited to the sole embodiment described above, but encompasses any and all embodiments within the scope of the following claims.

I claim:

1. A food support, comprising:

a plate having a bottom and a top;

a plurality of cups integrally fastened to the bottom of said plate, each of said cups having a plurality of walls angularly connected together so as to define a multi-sided socket and said walls having a peripheral recess opening into and fully surrounding said socket;

a plurality of pins each extending downwardly from the bottom of said plate into said socket of a respective one of said cups; and, a plurality of legs corresponding in number with said cups, each of said legs having:

a base adapted for selective insertion into said socket and snug, non-rotating engagement with said walls of a respective one of said cups, said base having a bore for snugly receiving one of said pins and a peripheral ridge for mated, snap-fit engagement with one said peripheral recess; and, an arcuate stem projecting downwardly from said base, each said arcuate stem bowing outwardly.

* * * * *